US005446949A

United States Patent [19]

Fudaki

[11] Patent Number: 5,446,949

[45] Date of Patent: Sep. 5, 1995

[54] SEPARABLE END STOP FOR CONCEALED SLIDE FASTENER

[75] Inventor: Tsutomu Fudaki, Toyama, Japan

[73] Assignee: Yoshida Kogyo K. K., Tokyo, Japan

[21] Appl. No.: 261,954

[22] Filed: Jun. 17, 1994

[30] Foreign Application Priority Data

Jun. 18, 1993 [JP] Japan ..... 5-147198

[51] Int. Cl.[6] ..... A44B 19/00

[52] U.S. Cl. ..... 24/433; 24/389; 24/434

[58] Field of Search ..... 24/433, 434, 432, 389, 24/388, 381, 418

[56] References Cited

U.S. PATENT DOCUMENTS

| | | | |
|---|---|---|---|
| 2,146,691 | 2/1939 | Sundback . | |
| 2,728,125 | 12/1955 | Wild . | |
| 4,112,553 | 9/1978 | Weitzner | 24/205 |
| 4,152,813 | 5/1979 | Heimberger | 24/434 |
| 4,414,718 | 11/1983 | Kumano | 24/396 |
| 4,742,603 | 5/1988 | Kasai | 24/434 |
| 4,942,648 | 7/1990 | Yoshida | 24/389 |
| 4,976,016 | 12/1990 | Takabatake | 24/434 |

FOREIGN PATENT DOCUMENTS 36-4816 2/1951 Japan .

*Primary Examiner*—Victor N. Sakran
*Attorney, Agent, or Firm*—Finnegan, Henderson, Farabow, Garrett & Dunner

[57] ABSTRACT

A separable end stop for concealed slide fasteners includes a box which has a guide slot extending in a front wall of the box for receiving and guiding folded portions of two stringers, and a retaining recess formed at an upper open end of the box for receiving therein the whole of a lower end portion of a slider body in such a manner that right and left front wall portions extending on opposite sides of the front wall overlap the corresponding wings of the slider body. Each of the front wall portions has an upper end extension projecting from the open upper end the box to ensure that the wings of the slider body are overlapped with the front wall portions of the box. The box further includes a locking portion formed on an interior surface facing a box-pin insertion hole, and a box pin has first and second locking portions on opposite sidewalls thereof, interlockingly engageable with the locking portion and a partition wall, respectively, to assemble the box and the box pin. The separable end stop thus constructed is able to engage engage and disengage two stringers smoothly and reliably and facilitates the sewing attachment between the stringers to an article.

5 Claims, 5 Drawing Sheets

SEPARABLE END STOP FOR CONCEALED SLIDE FASTENER

BACKGROUND OF THE INVENTION

1. Field of the Invention:

The present invention relates to a separable end stop attached to one end of a fastener chain of a concealed slide fastener so as to permit complete disengagement and then reengagement of two stringers while preventing a slider from leaving the fastener chain.

2. Description of the Prior Art:

One known separable end stop for concealed slide fasteners is disclosed in Japanese Utility Model Publication No. 48-39366. The disclosed separable end stop includes a box having at its upper end a recessed step in which a lower end portion of a slider body is received except a front side thereof. A front or obverse side of the box is shaped such that right and left front wall portions of the box come into contact with two opposed guide flanges of the slider body.

Another known separable end stop for concealed slide fasteners is disclosed in Japanese Utility Model Publication No. 51-4816, which includes a box and a box pin integrally formed such that the box pin and an upper end portion of the peripheral wall of the box jointly form an L-shaped groove in which a lower end portion of a slider body is received except a front side and one lateral side thereof.

The known separable end stops are unsatisfactory in that when the slider body is brought into abutment with the box, the box receives only a part of the entire periphery of the lower end portion of the slider body. The slider body thus received tends to wobble when a separable pin of the separable end stop is inserted into, or removed from the box through the slider body to engage or disengage the two stringers. Thus, smooth engaging and disengaging operation of the separable end stop can not be achieved. In addition, since the front wall portions of the box and the guide flanges of the slider body are only contacted in end to end abutment with each other, the slider body and the box are likely to separate from one another during the engaging and disengaging operation of the separable end stop, This separation not only hinders smooth engaging and disengaging operation of the separable end stop but also causes an accidental chain rupture or separation. Especially in the latter known separable end stop, since the box and the box pin are already mounted in an assembled or unitary form on one stringer before the stringer is attached by sewing to an article such as a garment or the like, the box is likely to constitute an obstacle during the sewing operation.

SUMMARY OF THE INVENTION

With the foregoing drawback of the prior art in view, it is an object of the present invention to provide a separable end stop for concealed slide fasteners, which includes a box having structural features that insure stable holding of the lower end portion of a slider body in a box to guarantee smooth engaging and disengaging operation of the separable end stop without causing accidental chain rupture or separation from the separable end stop, and enable a smooth sewing operation without interference with the box when one stringer is sewn to an article.

To attain the foregoing object, the present invention provides a separable end stop for a concealed slide fastener, which is composed of a box, a box pin and a separable pin, wherein the box has a guide slot extending in a front wall of the box for receiving and guiding folded portions of two stringers, and a retaining recess formed at an upper open end of the box for receiving the whole of a lower end portion of a slider body in such a manner that right and left front wall portions extending on opposite sides of the front wall overlap the corresponding wings of the slider body.

Preferably, each of the right and left front wall portions has an upper end extension projecting from the open upper end of the box to ensure that the wings of the slider body are overlapped with the front wall portions of the box.

The box preferably includes a locking portion formed on an interior surface facing a box-pin insertion hole which is separated by a partition wall from a separable-pin insertion hole. The box pin has a first locking portion on one side thereof and a second locking portion on an opposite side thereof. The first and second locking portions of the box pin are interlockingly engageable with the locking portion and the partition wall of the box to couple the box and the box pin in an assembled condition.

The above and other objects, features and advantages of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION

A preferred embodiment of the present invention will be described below in detail with reference to the accompanying drawings.

Figure 1:
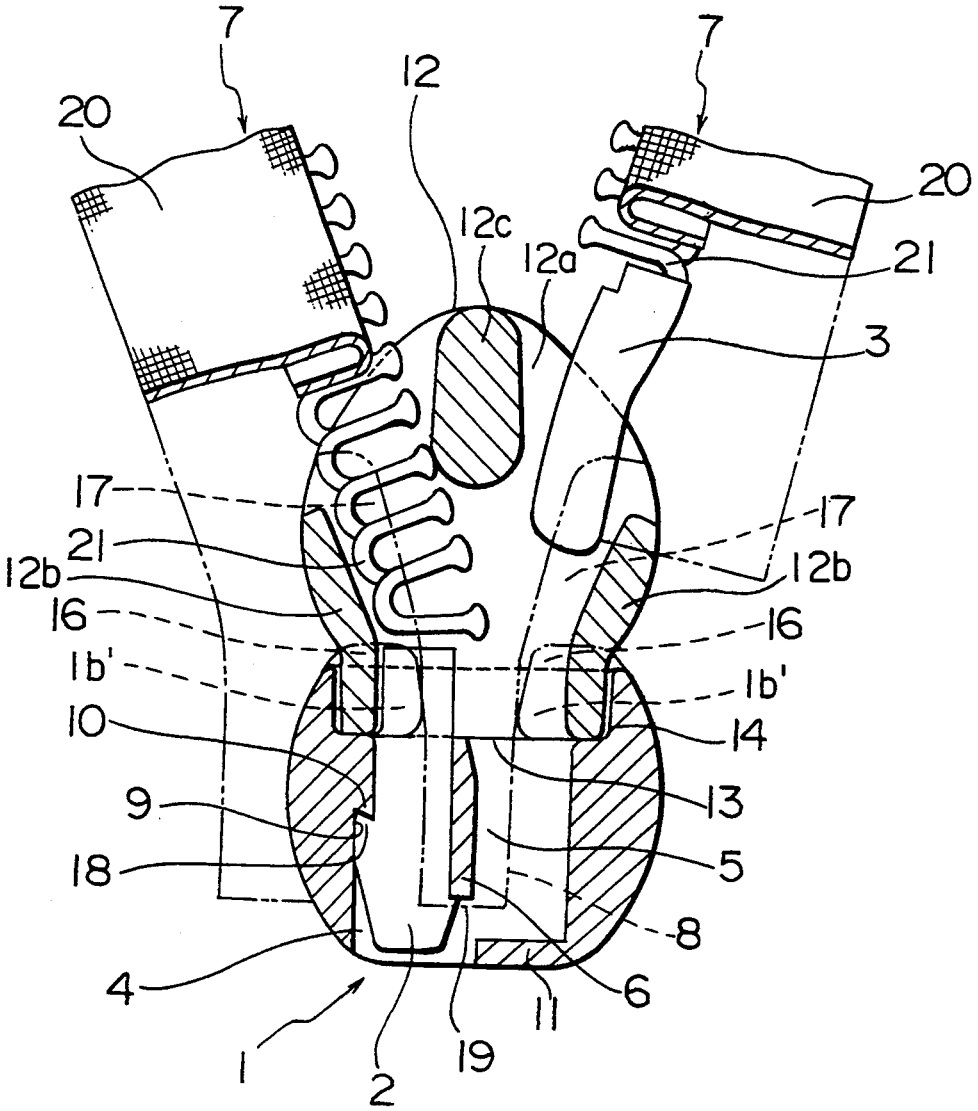
FIG. 1 is a front elevational view, partly in cross section, and partly cutaway, of one end portion of a concealed slide fastener, showing the operation of a separable end stop according to the present invention.
Figure 2:
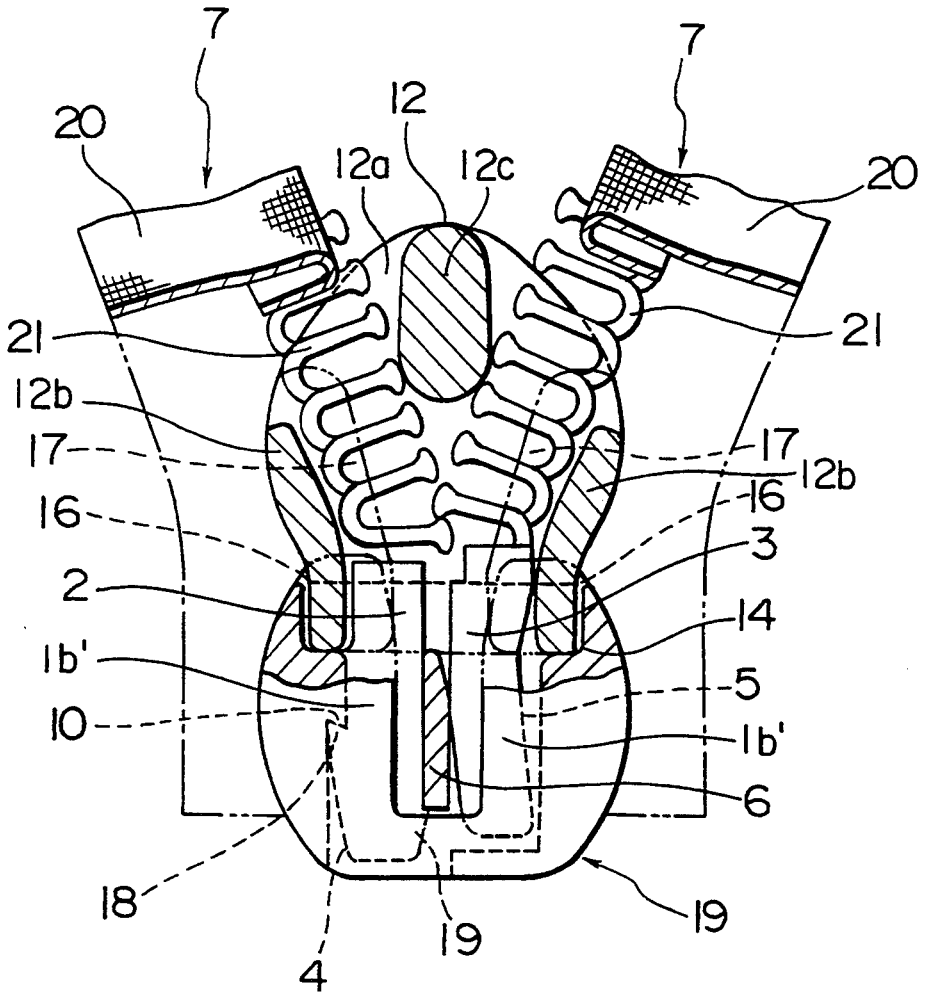
FIG. 2 is a view similar to FIG. 1 showing the separable end stop, with a separable pin inserted in a box through a slider body.

As shown in FIGS. 1 and 2, a separable end stop according to the present invention is attached to one end (bottom end) of a fastener chain of a concealed slide fastener so as to permit complete disengagement and then reengagement of two stringers 7, 7 while preventing a slider body 12 from leaving the fastener chain.

Each of the stringers 7, 7 includes a stringer tape 20 carrying on its inner longitudinal edge a row of coupling elements 21. The two stringers 7, 7 with the two engaged coupling element rows 21 form the fastener chain. The slider body 12 is movable along the coupling element rows 21 to engage and disengage the latter. The slider body 12 comprises a flanged base plate 12*a* and a pair of transversely spaced, elongated front wings 17, 17 extending inwardly from free ends of a pair of guide flanges 12*b*, 12*b* extending along opposite sides of the base plate 12*a*. The base plate 12*a* has a diamond 12*c* at a fore end thereof, there being defined between the base plate 12*a* and the front wings 17, 17 a Y-shaped guide channel 12*d* (FIG. 3) for the passage therethrough of the coupling element rows 21. The front wings 17, 17 are transversely spaced by a longitudinal slot 17*a* (FIG. 3) communicating with the Y-shaped guide channel 12*d*. The slot 17*a* receives and guides folded portions of the stringer tapes 20, 20.

The separable end stop is composed of three components, namely a box 1, a box pin 2 and a separable pin 3.

Figure 3:
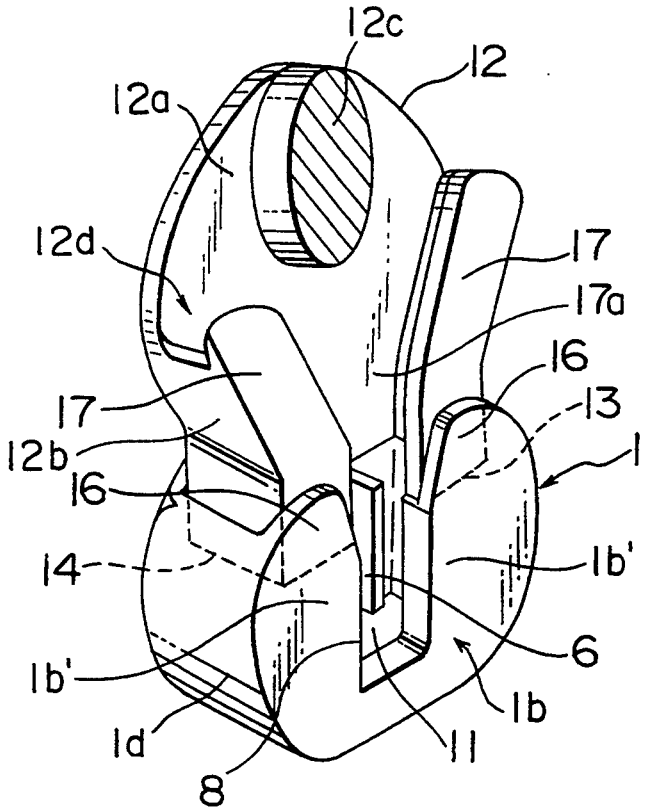
FIG. 3 is a perspective view, with parts cutaway for clarity, of a slider body fitted with the box of the separable end stop.
Figure 4:
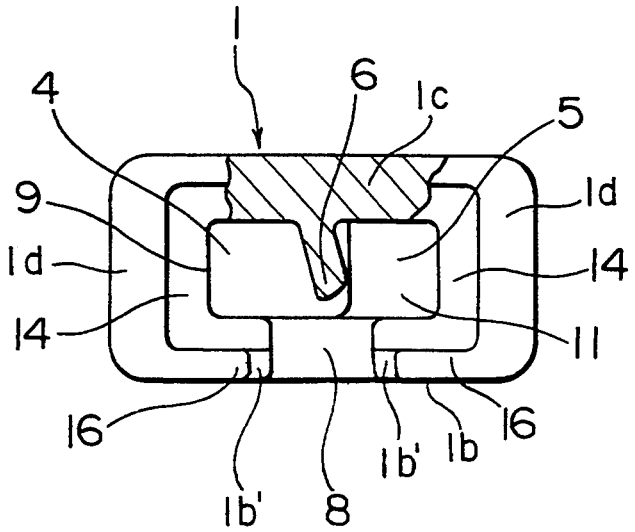
FIG. 4 a top view, with parts cutaway for clarity, of a box before being assembled with a box pin.
Figure 5:
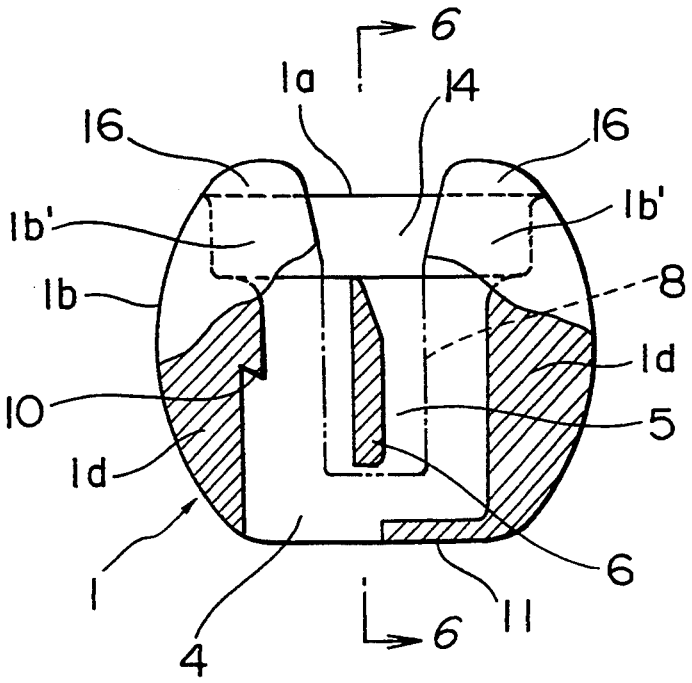
FIG. 5 is a front elevational view, with parts cutaway for clarity the box.
Figure 6:
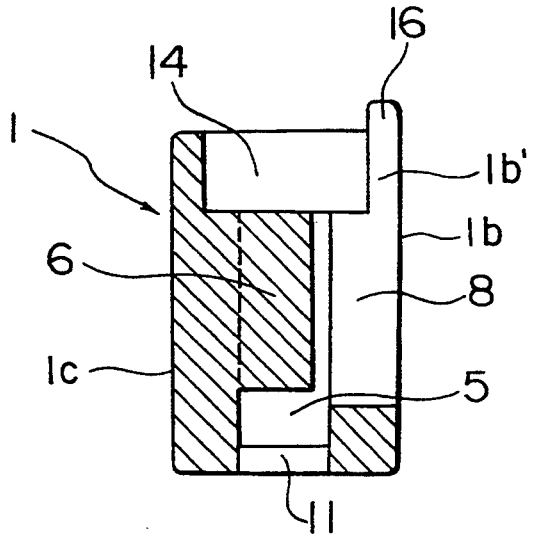
FIG. 6 cross-sectional view taken along line 6—6 of FIG. 5.

As shown in FIGS. 3, 5 and 6, the box 1 has a hollow structure and is open at an upper end 1*a* (FIG. 5). The box 1 includes a front wall 1*b* and a rear wall 1*c* (FIGS. 4 and 6) spaced from each other and interconnected by a pair of sidewalls 1*d*, 1*d* spaced from each other. The box 1 further has a pair of parallel spaced holes 4 and 5 extending from the open upper end 1*a* toward a lower end of the box 1 and transversely spaced by a partition wall 6 disposed centrally on an interior surface of the rear wall 1*c*. The hole 4 is shaped to fit the box pin 2, while the hole 5 is shaped to releasably receive the separable pin 3. The hole 4 is a through-hole extending across the box 1. An interior surface 9 of the sidewall 1*d* which defines one side of the hole 4 is partly offset to form a step-like locking portion 10 facing toward the lower end of the box 1 for a purpose described below. The step-like locking portion 10 on the sidewall 1*d* separates the hole 4 into an upper portion and a lower portion which is larger in width than the upper portion. A bottom wall 11 of the box 1 forms a bottom face of the hole 5.

As best shown in FIG. 3, the front wall 1*b* of the box 1 has a guide slot 8 formed to confront the partition wall 6 and extending from the open upper end 1*a* toward the lower end of the box 1 for receiving and guiding the folded portions of the respective stringer tapes 20, 20. The guide slot 8 terminates short of the lower end of the box 1 and communicates with both of the first and second holes 4, 5. As a result of formation of the guide slot 8, the front wall 1*b* is separated into right and left front wall portions 1*b*′, 1*b*′ spaced by the guide slot 8.

The box 1 has a retaining recess 14 formed at the open upper end 1*a* thereof for receiving therein the whole of a lower end portion 13 of the slider body 12. The retaining recess 14 is shaped to fit the entire periphery of the lower end portion 13 of the slider body 12. Thus, when the slider body 12 is brought into abutment with the box 1, the lower end portion 13 of the slider body 12 is fully received in the retaining recess 14, with the front wings 17 of the slider body 12 overlapped with the corresponding front wall portions 1*b*′ of the box 1. The front wall portions 1*b*′, 1*b*′ have a pair of upper end extensions 16, 16, respectively, projecting from the edge of the open upper end 1*a* of the box 1. The end extensions 16 also overlap the corresponding front wings 17 of the slider body 12 to rectify or correct the posture of the slider body 12 when the lower end portion 13 of the slider body 12 is received in the retaining recess 14 of the box 1.

The box pin 2 is composed of a tubular elongate member of a generally U-shaped cross section and attached to one stringer tape 20 at one end (bottom end) thereof, with a inner longitudinal edge of the stringer tape 20 received in a U-shaped groove in the box pin 2. The front end of the box pin 2 has a solid structure. The box pin 2 includes a first locking claw 18 formed on an outer sidewall of the box pin 2 at an intermediate portion thereof, and a second locking claw 19 formed on the inner sidewall of the box pin 2 adjacent the front end thereof. The first and second locking claw 18, 19 form first and second locking portions, respectively. When the box 1 and the box pin 2 are assembled together, the first and second locking claw 18, 19 of the box pin 2 are respectively interlocked with the step-like locking portion 10 and a lower end of the partition wall 6 of the box 1.

The separable pin 3 is composed of a tubular elongate member of a generally U-shaped cross section and attached to the other stringer tape 20 at one end (bottom end) thereof, with the inner longitudinal edge of the stringer tape 20 received in a U-shaped groove in the separable pin 3. The separable pin 3 is insertable into, and removed from the hole 5 in the box 1.

The separable end stop of the foregoing construction is assembled in a manner described below. The box 1 and the box pin 2 are initially formed separately from one another, and in the initial condition (preassembling condition), the partition wall 6 of the box 1 is slightly tilted toward the second hole side, as shown in FIG. 4.

Figure 7:
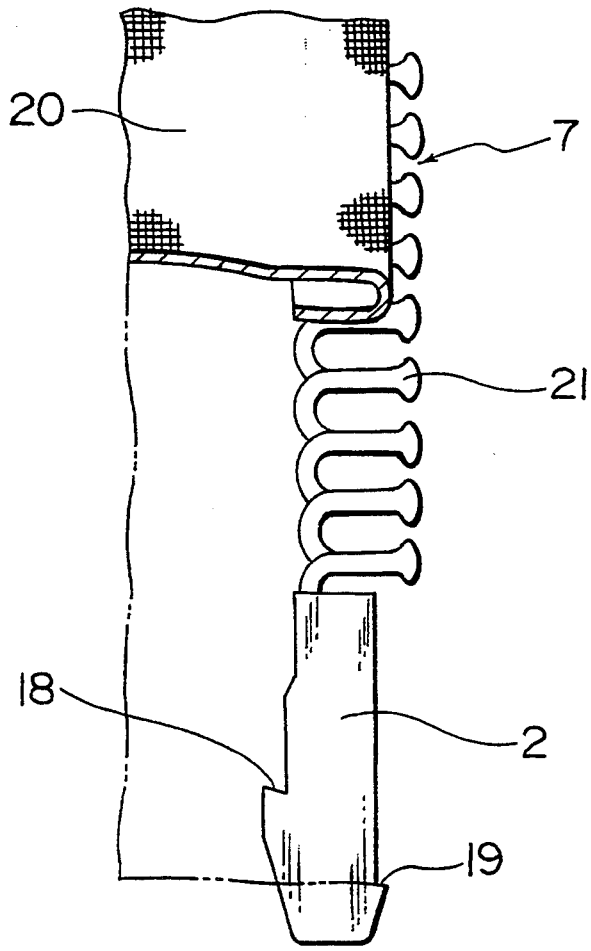
FIG. 7 is an exploded front elevational view, with parts cutaway for clarity, showing the manner in which a box pin and a box are assembled together.
Figure 7:
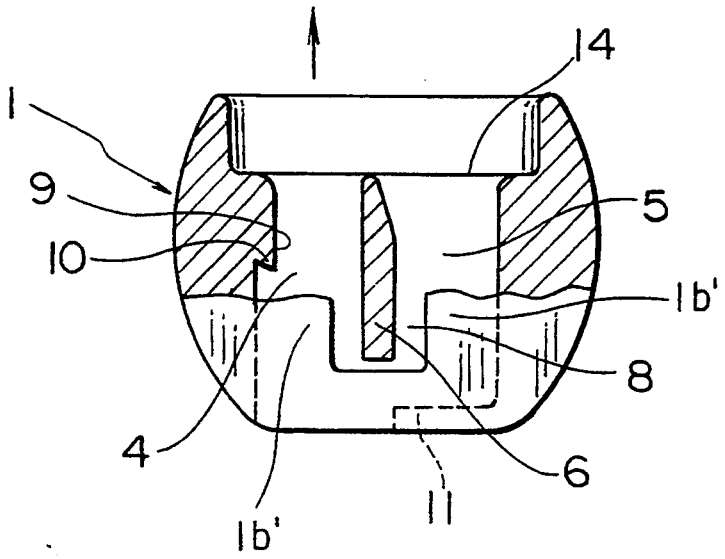

As shown in FIG. 7, one stringer 7 including the box pin 2 is attached by sewing to one longitudinal edge of an article such as a garment (not shown). Then, the stringer tape 20 of the stringer 7 is folded over itself along the inner longitudinal edge, and after that while keeping the folded condition of the stringer tape 20, the box pin 2 is inserted from the open upper end 1*a* of the box 2 into the hole 4. During that time, a folded portion of the stringer tape 20 is received in the guide slot 8 defined between the opposite front wall portions 1*b*′, 1*b*′ of the box 2. The box pin 2 is further inserted into the box 1 until the first locking claw 18 of the box pin 1 is interlocked with the lower end of the step-like locking portion 10 of the box 1, as shown in FIG. 1. Then, the partition wall 6, slightly tilted toward the second hole side, is raised up to an upstanding position with the result that the lower end of the partition wall 6 is, interlocked with the second locking claw 19. Namely, the partition wall 6 which is initially slightly tilted toward the second hole side is raised up to an upstanding position when the box pin 2 is inserted into the first hole 4 and reaches a position that the box pin 2 interlocks with the locking portion 10 and the partition wall 6. Now, the box 1 and the box pin 2 are firmly connected together. Thus, a complete stringer 7 which is equipped with the box and box-pin assembly and the slider body 12 (FIG. 1) is produced. The other stringer 7 including the separable pin 3 is also attached by sewing to the opposite longitudinal edge of the article. The stringer tape 20 of that stringer 7 is also folded over itself along the inner longitudinal edge thereof.

To engage the two stringers 7, 7 to close the concealed slide fastener, the slider body 12 on one stringer 7 is moved in a backward direction (opening direction) along the row of coupling elements 21 toward the box 2. When the slider body 12 rests on the box 1, as shown in FIG. 1, the lower end portion 13 of the slider body 12 is completely received in the retaining recess 14 in the box 1, with the front wings 17 of the slider body 12 overlapped with the front wall portions 1*b*′ of the box 1 including their upper end extensions 16. While keeping this condition, the separable pin 3 passes through the slider body 12 and then is inserted into the hole 5 in the box 1. The separable end stop thus assembled holds or retains the two stringers 7, 7 in alignment for interlocking. In this instance, the folded portion of the stringers 7, 7 are guidedly received in the guide slot 8 in the box 1 and also in the slot 17*a* in the slider body 12. Thereafter, the slider body 12 is moved in a forward direction (closing direction) away from the box 1 to engage the rows of coupling elements 21 of the stringers 7, 7, thereby closing the concealed slide fastener.

When the concealed slide fastener is to be opened, the slider body 12 is moved in the opening direction toward the box 1 to separate or disengage the rows of coupling elements 21 on the stringers 7, 7. When the slider body 12 is brought into abutment with the box 1, the lower end portion 13 of the slider body 12 is completely received in the retaining recess 14 of the box 1, as shown in FIG. 2. In this instance, the front wall portions 1*b*′ and their upper end extensions 16 of the box 1 overlap the corresponding front wings 17 of the slider body 12. Then, the stringer tape 20 is pulled to remove the separable pin 3 from the hole 5 in the box 1 and thence from the slider body 12. Thus, the two stringers 7, 7 are completely disengaged.

As described above, the separable end stop according to the present invention for a concealed slide fastener includes a box 1 having a guide slot 8 formed in a front wall 1*b* for receiving and guiding folded portions of two stringers 7, 7 of the concealed slide fastener. As a result of formation of the guide slot 8, the front wall 1*b* of the box 1 is separated into two front wall portions 1*b*′, 1*b*′ confronting together across the guide slot 8. The box 1 further has a retaining recess 14 formed at an open upper end 1*a* thereof for receiving the whole of a lower end portion 13 of a slider body 12 so as to hold the lower end portion 13 of the slider body 12 from the entire side thereof. In this instance, the front wall portions 1*b*′, 1*b*′ of the box 1 overlap the corresponding front wings 17, 17 of the slider body 12. With this arrangement, the slider body 12 is stably held on the box 1 without wobbling, so that the separable pin 3 can be smoothly inserted into, or removed from, the box 1 and the slider body 12 to engage or disengage the two stringers 7, 7. Thus, the separable end stop is able to perform the engaging and disengaging operation stably and reliably without involving an accidental chain rupture or separation which may sometimes take place in the conventional concealed slide fastener in the vicinity of the separable end stop.

In addition, since the end extensions 16 of the respective front wall portions 1*b*′ project from the open end 1*a* of the box 1, the slider body 12 while moving toward the box 1 is first brought into contact with the end extensions 16 before the lower end portion 13 of the slider body 12 is received in the retaining recess 14. Accordingly, even when the slider body 12 approaches the box 1 with an improper posture, the posture of the slider body 12 is corrected or rectified by the end extensions 16 of the front wall portions 1*b*′ before the lower end portion 13 of the slider body 12 are received in the retaining recess 14. The end extensions 16 thus ensure that the lower end portion 13 of the slider body 12 can be stably received in the retaining recess 14 in the box 1, with the front wings 17 of the slider body 12 overlapped with the corresponding front wall portions 1*b*′ of the box 1, regardless of the posture of the slider body 12. The lower end portion 13 of the slider body 12 can be always held in intimate contact with the box 1 and, hence, the separable pin 3 can be smoothly inserted in and removed from the box 1. Thus, the engaging and disengaging operation of the separable end stop can be achieved smoothly and reliably.

Yet, the box 1 and the box pin 2 are initially manufactured as separate components and they are assembled together via interlocking engagement between a step-like locking portion 10 facing the hole 4 in the box 1 and a first locking claw 18 on one sidewall of the box pin 2, and interlocking engagement between the lower end of a partition wall 6 of the box 1 and a second locking claw 19 on the opposite sidewall of the box pin 2. By virtue of such interlocking engagements, the box 1 and the box pin 2 can be assembled reliably with utmost ease. In addition, since the box 1 and the box pin 2 are assembled after the sewing which is taken to attach one stringer 7 including the box pin 2 to an article, the box 1 does not constitute an obstacle against the sewing operation and the sewing operation can, therefore, be achieved smoothly.

Obviously, various minor changes and modifications of the present invention are possible in the light of the above teaching. It is therefore to be understood that within the scope of the appended claims the invention may be practiced otherwise than as specifically described.

What is claimed is:

1. A separable end stop for a concealed slide fastener which includes a pair of stringers and a slider movable along opposed inner longitudinal edges of the stringers for opening and closing the concealed slide fastener, with folded portions of the respective stringers guided between two opposed wings of the slider body, said separable end stop comprising: a box and a box pin mounted on one of the stringers at one end thereof, and a separable pin mounted on the other stringer at one end thereof and insertable in said box to engage and disengage the two stringers, said box having an open upper end and including a front wall having a guide slot extending from said open upper end toward a lower end of said box for receiving and guiding the folded portion of the two stringers, said front wall being composed of a pair of right and left front wall portions separated by said guide slot, said box further having a retaining recess formed at said open upper end for receiving therein the whole of a lower end portion of the slider body, with said front wall portions of the box overlapping the wings of the slider body, respectively.

2. A separable end stop according to claim 1, wherein each of said front wall portions of said box has an upper end extension projecting from said open upper end of said box.

3. A separable end stop according to claim 1 or 2, wherein said box includes a central partition wall defining within said box a first hole for receiving therein said box pin and a second hole for receiving therein said separable pin, said box having a locking portion formed on an interior surface of said box facing said first hole, said box pin having a first locking portion on one side thereof and a second locking portion on an opposite side thereof, said first and second locking portions of said box pin being interlockingly engageable with said locking portion and said partition wall of said box to couple said box and said box pin in an assembled condition.

4. A separable end stop according to claim 3, wherein said locking portion of said box is a step formed on said interior surface and facing away from said open upper end of said box, and said first and second locking portions of said box pin are locking claws.

5. A separable end stop according to claim 3, wherein said partition wall which is initially slightly tilted toward said second hole side is raised up to an upstanding position when said box pin is inserted into said first hole and reaches a position that said box pin interlocks with said locking portion and said partition wall.

* * * * *